US011193253B2

(12) United States Patent
Ono

(10) Patent No.: US 11,193,253 B2
(45) Date of Patent: Dec. 7, 2021

(54) WORK VEHICLE HAVING IMAGE PICK-UP APPARATUS

(71) Applicant: KOMATSU LTD., Tokyo (JP)

(72) Inventor: Yutaka Ono, Tokyo (JP)

(73) Assignee: KOMATSU LTD., Tokyo (JP)

( * ) Notice: Subject to any disclaimer, the term of this patent is extended or adjusted under 35 U.S.C. 154(b) by 395 days.

(21) Appl. No.: 16/082,611

(22) PCT Filed: Mar. 3, 2017

(86) PCT No.: PCT/JP2017/008526

§ 371 (c)(1),
(2) Date: Sep. 6, 2018

(87) PCT Pub. No.: WO2017/163822

PCT Pub. Date: Sep. 28, 2017

(65) Prior Publication Data

US 2020/0378085 A1 Dec. 3, 2020

(30) Foreign Application Priority Data

Mar. 23, 2016 (JP) ..... JP2016-058837

(51) Int. Cl.
*E02F 3/84* (2006.01)
*E02F 3/815* (2006.01)
(Continued)

(52) U.S. Cl.
CPC ..... *E02F 3/815* (2013.01); *E02F 3/764* (2013.01); *E02F 3/847* (2013.01); *E02F 9/26* (2013.01)

(58) Field of Classification Search
CPC ..... E02F 3/76; E02F 3/764; E02F 3/80; E02F 3/815; E02F 9/26; E02F 3/7668; E02F 3/842; E02F 3/847
See application file for complete search history.

(56) References Cited

U.S. PATENT DOCUMENTS 4,807,131 A * 2/1989 Clegg ..... E02F 3/842 172/4.5
4,807,461 A 2/1989 Brimeyer et al.
(Continued)

FOREIGN PATENT DOCUMENTS

CN 101238253 A 8/2008
CN 101646885 A 2/2010
(Continued)

OTHER PUBLICATIONS

Heiji Yoshizawa et al., "Underwater Bulldozer," Komatsu Gihour, 1970, pp. 79-86, vol. 16, No. 4, including partial English translation.

*Primary Examiner* — Gary S Hartmann
(74) *Attorney, Agent, or Firm* — Faegre Drinker Biddle & Reath LLP

(57) ABSTRACT

A work vehicle is capable of readily knowing an amount of soil built up on a front surface of a blade. A motor grader includes a vehicular body frame, a blade, and an image pick-up apparatus. The blade is arranged between a front end of the vehicular body frame and a rear end of the vehicular body frame. The blade is supported on the vehicular body frame. The image pick-up apparatus is arranged in front of the blade. At least a part of the blade is included within an angle of view of the image pick-up apparatus. A revolving operation of the blade is automatically controlled based on the amount of soil built up on the front surface of the blade.

9 Claims, 11 Drawing Sheets

(51) Int. Cl.
*E02F 3/76* (2006.01)
*E02F 9/26* (2006.01)

(56) References Cited

U.S. PATENT DOCUMENTS

| | | | | |
|---|---|---|---|---|
| 6,230,818 | B1 | 5/2001 | Slander | |
| 6,470,606 | B1 * | 10/2002 | Nagahiro | E02F 3/847 37/348 |
| 6,581,695 | B2 * | 6/2003 | Bernhardt | A01B 59/068 172/439 |
| 9,038,289 | B2 * | 5/2015 | Kelly | E02F 9/2029 37/412 |
| 9,422,692 | B2 * | 8/2016 | Taylor | E02F 9/264 |
| 9,481,983 | B2 * | 11/2016 | Taylor | E02F 3/842 |
| 9,650,763 | B2 * | 5/2017 | Taylor | E02F 9/2045 |
| 9,970,180 | B2 * | 5/2018 | Enix | E02F 9/262 |
| 10,293,752 | B2 * | 5/2019 | Yamashita | E02F 9/261 |
| 10,634,492 | B2 * | 4/2020 | Beery | E02F 3/7636 |
| 10,753,066 | B2 * | 8/2020 | Ono | E02F 3/844 |
| 10,961,685 | B2 * | 3/2021 | Ono | E02F 3/8152 |
| 2008/0185162 | A1 | 8/2008 | Maeda | |
| 2010/0044060 | A1 | 2/2010 | Shiohara et al. | |
| 2012/0199371 | A1 | 8/2012 | Sakai et al. | |
| 2013/0255977 | A1 * | 10/2013 | Braunstein | E02F 3/765 172/4.5 |
| 2013/0304331 | A1 * | 11/2013 | Braunstein | E02F 3/844 701/50 |
| 2015/0152623 | A1 | 6/2015 | Yamazaki | |
| 2017/0050566 | A1 | 2/2017 | Yamashita et al. | |
| 2019/0078292 | A1 * | 3/2019 | Ono | G01C 3/08 |
| 2020/0270844 | A1 * | 8/2020 | Kean | E02F 3/7654 |
| 2020/0270847 | A1 * | 8/2020 | Kean | E02F 3/7636 |
| 2020/0393303 | A1 * | 12/2020 | Betournay | B64C 39/024 |
| 2021/0017738 | A1 * | 1/2021 | Sano | G01G 19/12 |

FOREIGN PATENT DOCUMENTS

| | | | |
|---|---|---|---|
| CN | 102575594 | A | 7/2012 |
| CN | 104126043 | A | 10/2014 |
| JP | S59-043561 | U | 3/1984 |
| JP | S60-123633 | A | 7/1985 |
| JP | S62-170619 | A | 7/1987 |
| JP | H05-339959 | A | 12/1993 |
| JP | 2001-146761 | A | 5/2001 |
| JP | 2002-532643 | A | 10/2002 |
| JP | 2010-043446 | A | 2/2010 |
| JP | 2015-94069 | A | 5/2015 |
| WO | WO-00/36231 | A1 | 6/2000 |
| WO | WO 2016/031009 | A | 2/2017 |

* cited by examiner

WORK VEHICLE HAVING IMAGE PICK-UP APPARATUS

TECHNICAL FIELD

The present invention relates to a work vehicle.

BACKGROUND ART

A construction for a work vehicle in which a work implement is arranged in front of a vehicular body and a camera capable of shooting the work implement is provided has conventionally been proposed (see, for example, PTD 1 and NPD 1).

CITATION LIST

Patent Document

PID 1: Japanese Patent Laying-Open No. 2001-146761

Non Patent Document

NPD 1: Heiji Yoshizawa, Katsuji Ishikawa, "Underwater Bulldozer," Komatsu Gihou, Vol. 16, No. 4, 1970, pp. 79-86

SUMMARY OF INVENTION

Technical Problem

A motor grader includes a blade arranged between a front end and a rear end of a vehicular body frame. An amount of soil built up on a front surface of the blade can be increased and decreased by adjusting an angle of inclination of the blade in a fore/aft direction in the motor grader.

Skills, however, are required to appropriately adjust the angle of inclination of the blade so as to build up an optimal amount of soil corresponding to current topography on the front surface of the blade. For example, when an unskilled operator sets an excessively large angle of inclination of the blade, an amount of soil built up on the front surface of the blade is excessive and a high load is applied to the blade. Consequently, rear wheels may idle to thereby cut away the ground after land-grading by the blade, or an engine may stall.

An object of the present invention is to provide a work vehicle capable of readily knowing an amount of soil built up on a front surface of a blade.

Solution to Problem

A work vehicle according to the present invention includes a vehicular body frame, a blade, and an image pick-up apparatus. The blade is arranged between a front end of the vehicular body frame and a rear end of the vehicular body frame. The blade is supported on the vehicular body frame. The image pick-up apparatus is arranged in front of the blade. The image pick-up apparatus includes at least a part of the blade within an angle of view.

Advantageous Effects of Invention

According to the present invention, an amount of soil built up on the front surface of the blade can readily be known.

DESCRIPTION OF EMBODIMENTS

Figure 1:
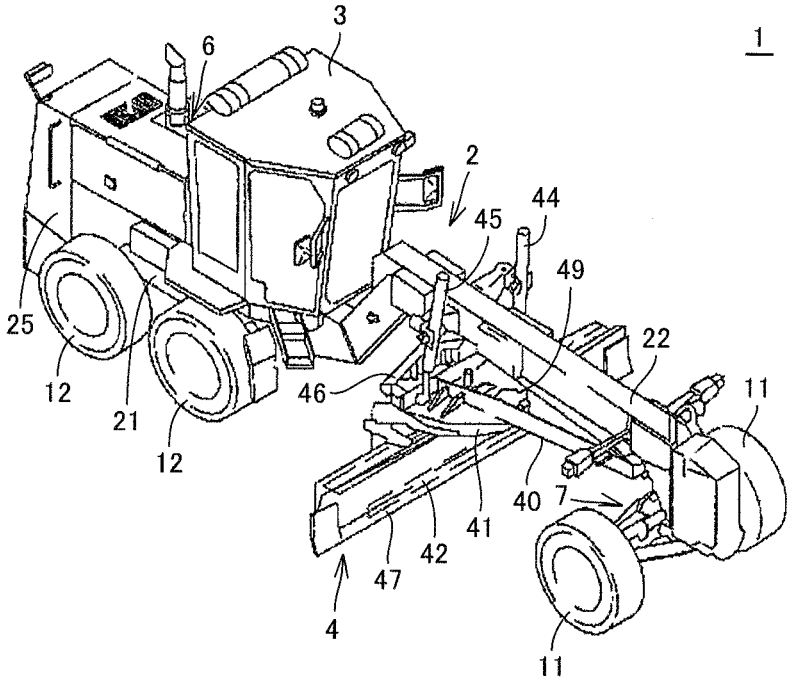
FIG. 1 is a perspective view schematically showing a construction of a motor grader based on a first embodiment.

A work vehicle according to an embodiment of the present invention will be described below with reference to the drawings. The same elements have the same reference characters allotted in the description below and their labels and functions are also the same. Therefore, detailed description thereof will not be repeated.

First Embodiment

A construction of a motor grader representing one example of a work vehicle to which the concept of the present invention is applicable will initially be described.

Figure 2:
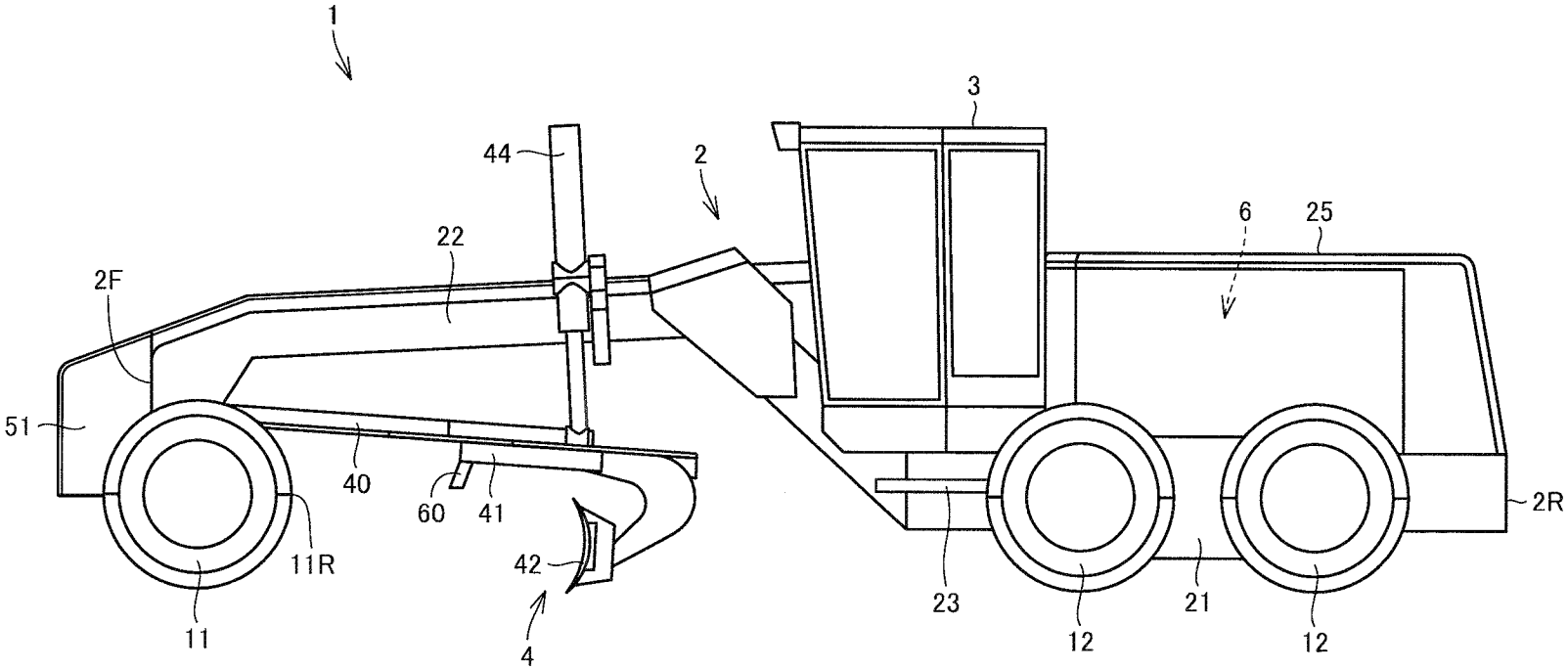
FIG. 2 is a side view schematically showing the construction of the motor grader based on the first embodiment.

FIG. 1 is a perspective view schematically showing a construction of a motor grader 1 based on a first embodiment. FIG. 2 is a side view schematically showing the construction of motor grader 1 based on the first embodiment. As shown in FIGS. 1 and 2, motor grader 1 in the present embodiment mainly includes running wheels 11 and 12, a vehicular body frame 2, a cab 3, and a work implement 4. Motor grader 1 includes components such as an engine arranged in an engine compartment 6. Work implement 4 includes a blade 42. Motor grader 1 can do such works as land-grading works, snow removal works, light cutting, and mixing of materials with blade 42.

Running wheels 11 and 12 include a front wheel 11 and a rear wheel 12. Though FIGS. 1 and 2 show running wheels six in total which consist of two front wheels 11 one on each side and four rear wheels 12 two on each side, the number of front wheels and rear wheels and arrangement thereof are not limited to the example shown in FIGS. 1 and 2.

In the description of the drawings below, a direction in which motor grader 1 travels in straight lines is referred to as a fore/aft direction of motor grader 1. In the fore/aft direction of motor grader 1, a side where front wheel 11 is arranged with respect to work implement 4 is defined as the fore direction. In the fore/aft direction of motor grader 1, a side where rear wheel 12 is arranged with respect to work implement 4 is defined as the aft direction. A lateral direction of motor grader 1 is a direction orthogonal to the fore/aft direction in a plan view. A right side and a left side in the lateral direction in facing front are defined as a right direction and a left direction, respectively. An upward/downward direction of motor grader 1 is a direction orthogonal to the plane defined by the fore/aft direction and the lateral direction. A side in the upward/downward direction where the ground is located is defined as a lower side and a side where the sky is located is defined as an upper side.

The fore/aft direction refers to a fore/aft direction of an operator who sits at an operator's seat in cab 3. The lateral direction refers to a lateral direction of the operator who sits at the operator's seat. The lateral direction refers to a direction of a vehicle width of motor grader 1. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

Front wheel 11 includes a rearmost portion 11R Rearmost portion 11R is a portion of front wheel 11 located rearmost.

Vehicular body frame 2 extends in the fore/aft direction (the lateral direction in FIG. 2). Vehicular body frame 2 includes a front end 2F in a foremost portion and a rear end 2R in a rearmost portion. Vehicular body frame 2 includes a rear frame 21 and a front frame 22.

Rear frame 21 supports an exterior cover 25 and components such as an engine arranged in an engine compartment 6. Exterior cover 25 covers engine compartment 6. For example, each of four rear wheels 12 is attached to rear frame 21 as being rotatably driven by driving force from the engine.

Front frame 22 is attached in front of rear frame 21. Front frame 22 is pivotably coupled to rear frame 21. Front frame 22 extends in the fore/aft direction. Front frame 22 includes a base end portion coupled to rear frame 21 and a tip end portion opposite to the base end portion. The base end portion of front frame 22 is coupled to the tip end portion of rear frame 21 with a vertical central pin being interposed.

An articulation cylinder 23 is attached between front frame 22 and rear frame 21. Front frame 22 is provided as being pivotable with respect to rear frame 21 owing to extending and retracting of articulation cylinder 23. Articulation cylinder 23 is provided as being extensible and retractable in response to an operation of a control lever provided in cab 3.

For example, two front wheels 11 are rotatably attached to the tip end portion of front frame 22. Front wheel 11 is attached to front frame 22 as being revolvable owing to extending and retracting of a steering cylinder 7. Motor grader 1 can change its direction of travel owing to extending and retracting of steering cylinder 7. Steering cylinder 7 can extend and retract in response to an operation of a steering wheel or a steering control lever provided in cab 3.

A counter weight 51 is attached to front end 2F of vehicular body frame 2. Counter weight 51 represents one type of attachments to be attached to front frame 22. Counter weight 51 is attached to front frame 22 in order to increase a downward load to be applied to front wheel 11 to allow steering and to increase a pressing load on blade 42.

Cab 3 is carried on front frame 22. In cab 3, an operation portion (not shown) such as a steering wheel, a gear shift lever, a lever for controlling work implement 4, a brake, an accelerator pedal, and an inching pedal is provided. Cab 3 may be carried on rear frame 21.

Figure 3:
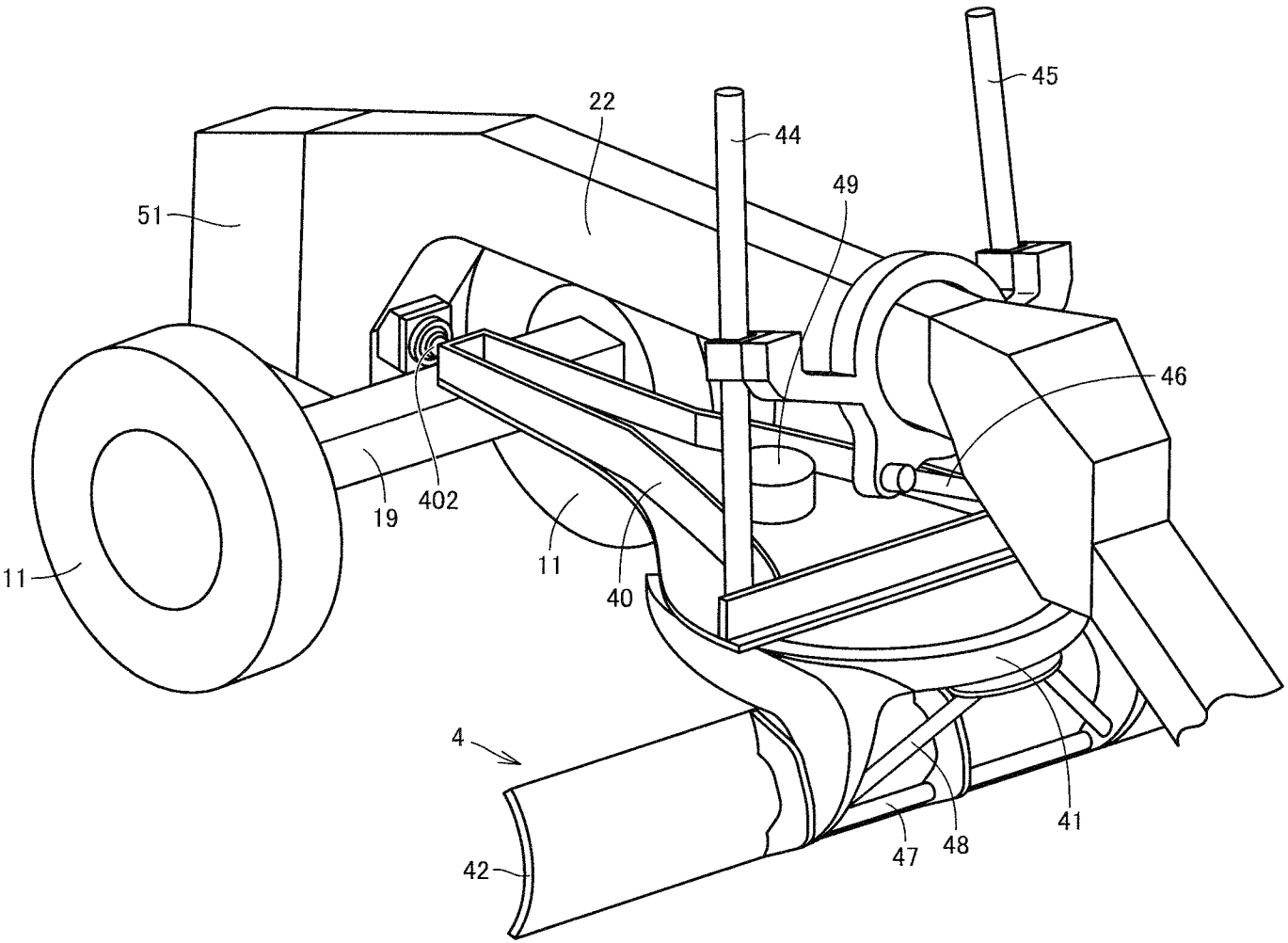
FIG. 3 is an enlarged perspective view showing a main part of a work implement of the motor grader shown in FIG. 2.

FIG. 3 is an enlarged perspective view showing a main part of work implement 4 of motor grader 1 shown in FIG. 2. As shown in FIGS. 2 and 3, work implement 4 mainly includes a draw bar 40, a swing circle 41, and blade 42.

Draw bar 40 is arranged below front frame 22. Draw bar 40 has a front end portion coupled to the tip end portion of front frame 22 with a ball bearing portion 402. Draw bar 40 has the front end portion swingably attached to the tip end portion of front frame 22.

Draw bar 40 has a rear end portion supported on front frame 22 by lift cylinders 44 and 45. Owing to extending and retracting of lift cylinders 44 and 45, the rear end portion of draw bar 40 can move up and down with respect to front frame 22. Draw bar 40 is vertically swingable with an axis along a direction of travel of the vehicle being defined as the center, as a result of extending and retracting of lift cylinders 44 and 45. As a result of extending and retracting of a draw bar shift cylinder 46, draw bar 40 is movable laterally with respect to front frame 22.

Swing circle 41 is arranged below front frame 22. Swing circle 41 is arranged below draw bar 40. Swing circle 41 is revolvably (rotatably) attached to the rear end portion of draw bar 40. Swing circle 41 can be driven by a hydraulic motor 49 as being revolvable clockwise and counterclockwise with respect to draw bar 40 when viewed from above the vehicle. Blade 42 is disposed on swing circle 41. As swing circle 41 is driven to revolve, a blade angle of blade 42 is adjusted. As will be described in detail later with reference to FIG. 5, the blade angle refers to an angle of inclination of blade 42 with respect to the fore/aft direction of motor grader 1.

Blade 42 is arranged between front wheel 11 and rear wheel 12. Front wheel 11 is arranged in front of blade 42. Rear wheel 12 is arranged in the rear of blade 42. Blade 42 is arranged between front end 2F of vehicular body frame 2 and rear end 2R of vehicular body frame 2. Blade 42 is supported on swing circle 41. Blade 42 is supported on draw bar 40 with swing circle 41 being interposed. Blade 42 is supported on front frame 22 with swing circle 41 and draw bar 40 being interposed.

Blade 42 is supported as being movable in the lateral direction with respect to swing circle 41. Specifically, a blade shift cylinder 47 is attached to swing circle 41 and blade 42 and arranged along a longitudinal direction of blade 42. With blade shift cylinder 47, blade 42 is movable in the lateral direction with respect to swing circle 41. Blade 42 is movable in a direction intersecting with a longitudinal direction of front frame 22.

Blade 42 is supported as being swingable around an axis extending in the longitudinal direction of blade 42 with respect to swing circle 41. Specifically, a tilt cylinder 48 is attached to swing circle 41 and blade 42. As a result of extending and retracting of tilt cylinder 48, blade 42 swings around the axis extending in the longitudinal direction of blade 42 with respect to swing circle 41, so that an angle of inclination of blade 42 with respect to the direction of travel of the vehicle can be changed.

As set forth above, blade 42 is constructed to be able to move up and down with respect to the vehicle, swing around the axis along the direction of travel of the vehicle, change an angle of inclination with respect to the fore/aft direction, move in the lateral direction, and swing around the axis extending in the longitudinal direction of blade 42, with draw bar 40 and swing circle 41 being interposed.

Figure 4:
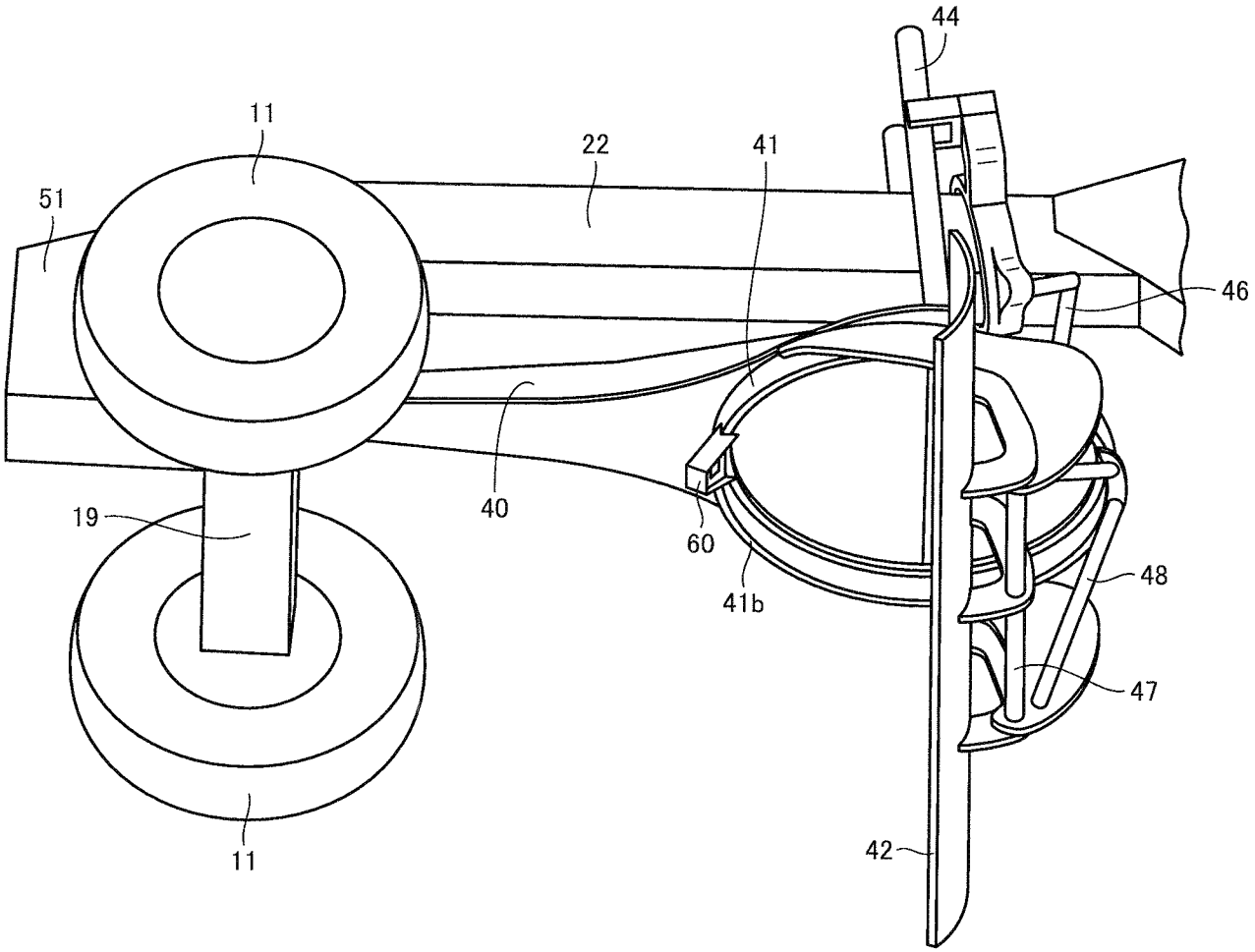
FIG. 4 is a perspective view from a different angle, of the work implement shown in FIG. 3.

FIG. 4 is a perspective view from a different angle, of work implement 4 shown in FIG. 3. Swing circle 41 includes a lower surface 41*b*. As shown in FIGS. 2 and 4, an image pick-up apparatus 60 is fixed to lower surface 41*b* of swing circle 41. Image pick-up apparatus 60 protrudes downward from lower surface 41*b* of swing circle 41. Image pick-up apparatus 60 is configured to pick up an image of blade 42 from the front.

Image pick-up apparatus 60 is arranged in front of blade 42. Image pick-up apparatus 60 is arranged between blade 42 and a rearmost portion 11R of front wheel 11. Image pick-up apparatus 60 is arranged in front of lift cylinders 44 and 45. Image pick-up apparatus 60 is arranged as facing a front surface of blade 42. Image pick-up apparatus 60 can pick up an image of the front surface of blade 42. Image pick-up apparatus 60 is arranged in the rear of front wheel 11. Image pick-up apparatus 60 is arranged in the rear of front end 2F of vehicular body frame 2.

Image pick-up apparatus 60 is arranged below front frame 22. Image pick-up apparatus 60 is arranged below draw bar 40. Image pick-up apparatus 60 is arranged below swing circle 41.

Image pick-up apparatus 60 is attached at a position in annular swing circle 41 most distant from blade 42. While swing circle 41 is arranged such that blade 42 extends in the lateral direction, image pick-up apparatus 60 is attached to a foremost portion of swing circle 41.

Image pick-up apparatus 60 is provided as being revolvable (rotatable) together with swing circle 41. Image pick-up apparatus 60 and blade 42 revolve together with revolution and rotation of swing circle 41.

Figure 5:
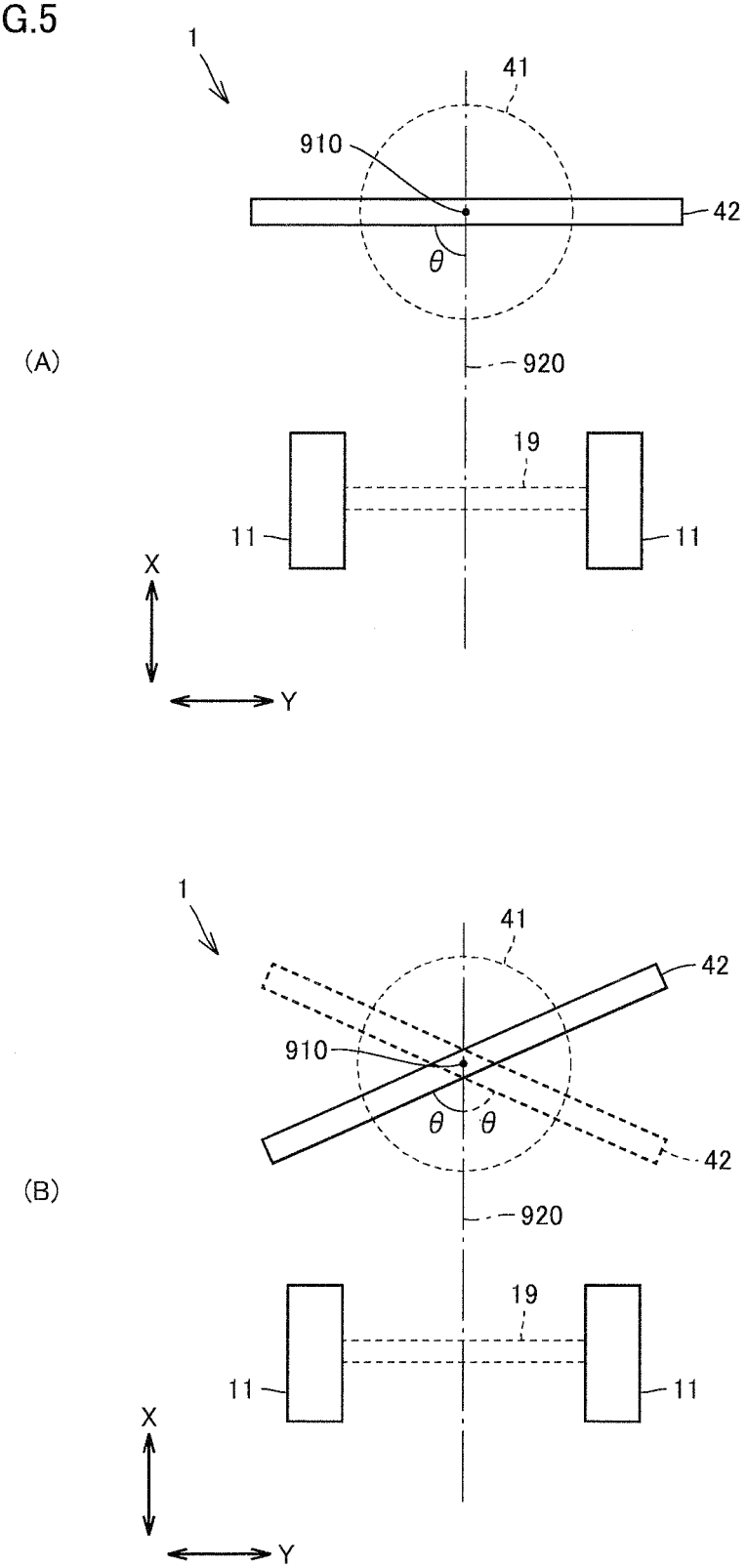
FIG. 5 is a diagram for illustrating a blade angle.

FIG. 5 is a diagram for illustrating a blade angle θ. FIG. 5 schematically shows front wheel 11, blade 42, an axle shaft 19, and swing circle 41 in a plan view, among the components of motor grader 1. FIG. 5 shows the fore/aft direction with an arrow X and shows the lateral direction with an arrow Y.

Front wheel 11 is connected to axle shaft 19. Axle shaft 19 is orthogonal to a central axis 920 of front frame 22.

As shown in states (A) and (B) in FIG. 5, blade 42 rotates around a rotation axis 910 as swing circle 41 is driven to revolve. As blade 42 rotates around rotation axis 910, blade angle θ varies. Blade 42 is provided such that blade angle θ is adjustable.

Blade angle θ shown in FIG. 5 refers to an angle formed between the direction of travel of the vehicular body and blade 42. Blade angle θ refers to an angle formed between the direction of travel of the vehicular body (the fore/aft direction and the X direction shown in FIG. 5) and blade 42 while motor grader 1 travels straight. Blade angle θ is an angle formed between central axis 920 of front frame 22 and blade 42. Blade angle θ refers to an angle formed between the fore/aft direction of motor grader 1 and a lower end of blade 42. Blade angle θ refers to an angle of inclination of blade 42 with respect to the longitudinal direction of front frame 22.

Blade angle θ is normally set in a range between 45° and 60°. A range of blade angle θ is set to a range not smaller than 0° and not larger than 90°.

Figure 6:
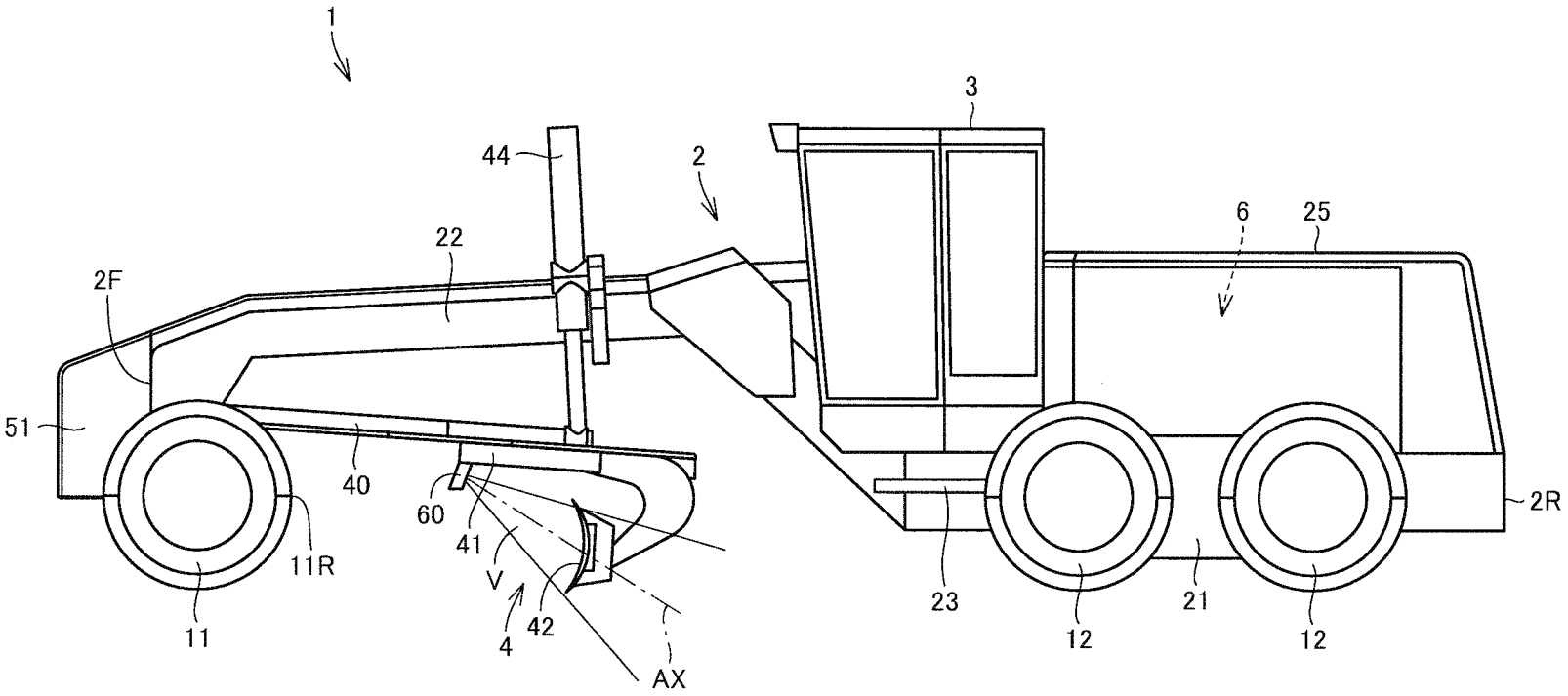
FIG. 6 is a schematic diagram showing a range of image pick-up by an image pick-up apparatus shown in FIG. 4.
Figure 10:
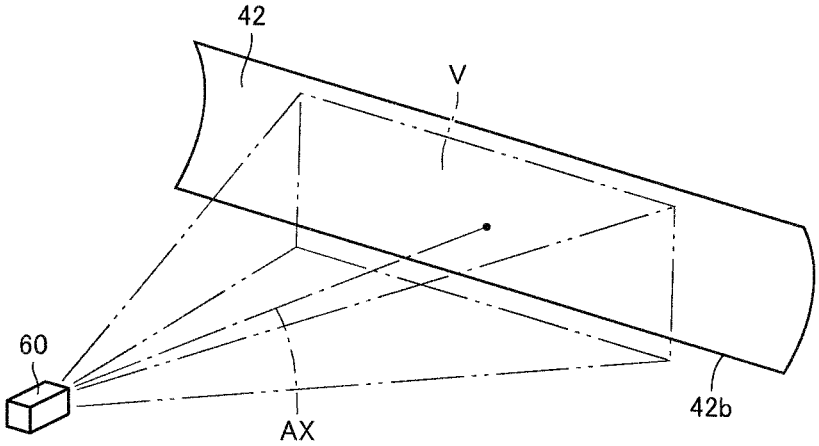
FIG. 10 is a schematic diagram showing a range of image pick-up by the image pick-up apparatus.
Figure 11:
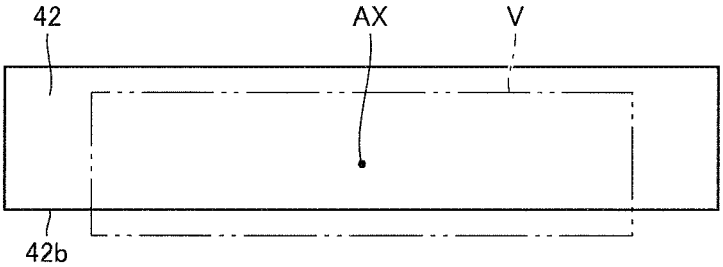
FIG. 11 is a schematic diagram showing a range of image pick-up by the image pick-up apparatus.

FIGS. 6, 10, and 11 are schematic diagrams showing a range of image pick-up by image pick-up apparatus 60 shown in FIG. 4. FIG. 10 schematically shows blade 42 and image pick-up apparatus 60 among the components of motor grader 1, in a direction from obliquely front. FIG. 11 schematically shows blade 42 from the front. An optical axis AX shown with a chain dotted line in FIGS. 6 and 10 represents an optical axis of image pick-up apparatus 60.

Optical axis AX is oriented rearward from image pick-up apparatus 60. Optical axis AX forms an angle downward with respect to a horizontal direction. Optical axis AX is inclined at an angle of depression with respect to the horizontal direction. Optical axis AX extends through a position of blade 42. Optical axis AX intersects with blade 42 as shown in FIGS. 10 and 11.

A range between two solid lines which radially extend from image pick-up apparatus 60 shown in FIG. 6 represents an angle of view V of image pick-up apparatus 60. A range surrounded by chain double dotted lines shown in FIGS. 10 and 11 represents angle of view V of image pick-up apparatus 60. Image pick-up apparatus 60 picks up an image of an object included in angle of view V.

Blade 42 is included in the range of image pick-up by image pick-up apparatus 60. A part of blade 42 is included in angle of view V of image pick-up apparatus 60. A lower end 42*b* of blade 42 is included in angle of view V of image pick-up apparatus 60. Image pick-up apparatus 60 picks up an image of the front surface of blade 42. Image pick-up apparatus 60 can pick up an image of soil built up on the front surface of blade 42 while motor grader 1 travels forward.

An amount of soil built up on the front surface of blade 42 can readily be known through image pick-up by image pick-up apparatus 60. By using the amount of soil for a revolving operation of blade 42, the amount of soil held by blade 42 can be optimized and highly accurate and highly efficient land-grading works can be done.

For example, by showing a picked-up image of the front surface of blade 42 on a monitor provided in cab 3, an operator who is on board cab 3 can visually recognize soil built up on the front surface of blade 42. The operator can optimally adjust blade angle θ (FIG. 5) in consideration of a condition of running of motor grader 1, current topography in front of motor grader 1, and an amount of soil held in blade 42 at the current time point. A revolving operation of blade 42 can also automatically be controlled based on the amount of soil built up on the front surface of blade 42.

Figure 12:
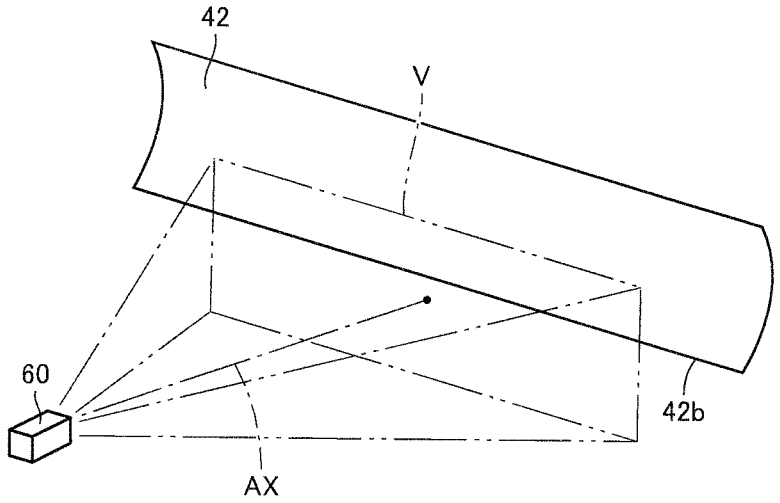
FIG. 12 is a schematic diagram showing another example of a range of image pick-up by the image pick-up apparatus.

FIG. 12 is a schematic diagram showing another example of a range of image pick-up by image pick-up apparatus 60. A range of image pick-up by image pick-up apparatus 60 is not limited to the example in which optical axis AX shown in FIGS. 6, 10, and 11 intersects with blade 42. As shown in FIG. 12, optical axis AX of image pick-up apparatus 60 does not necessarily have to intersect with blade 42.

In the example shown in FIG. 12 as well, a part of blade 42, or typically lower end 42*b* of blade 42, is included in angle of view V of image pick-up apparatus 60. Therefore, as in the example shown in FIGS. 6, 10, and 11, an amount of soil built up on the front surface of blade 42 can readily be known through image pick-up by image pick-up apparatus 60.

Second Embodiment

Figure 7:
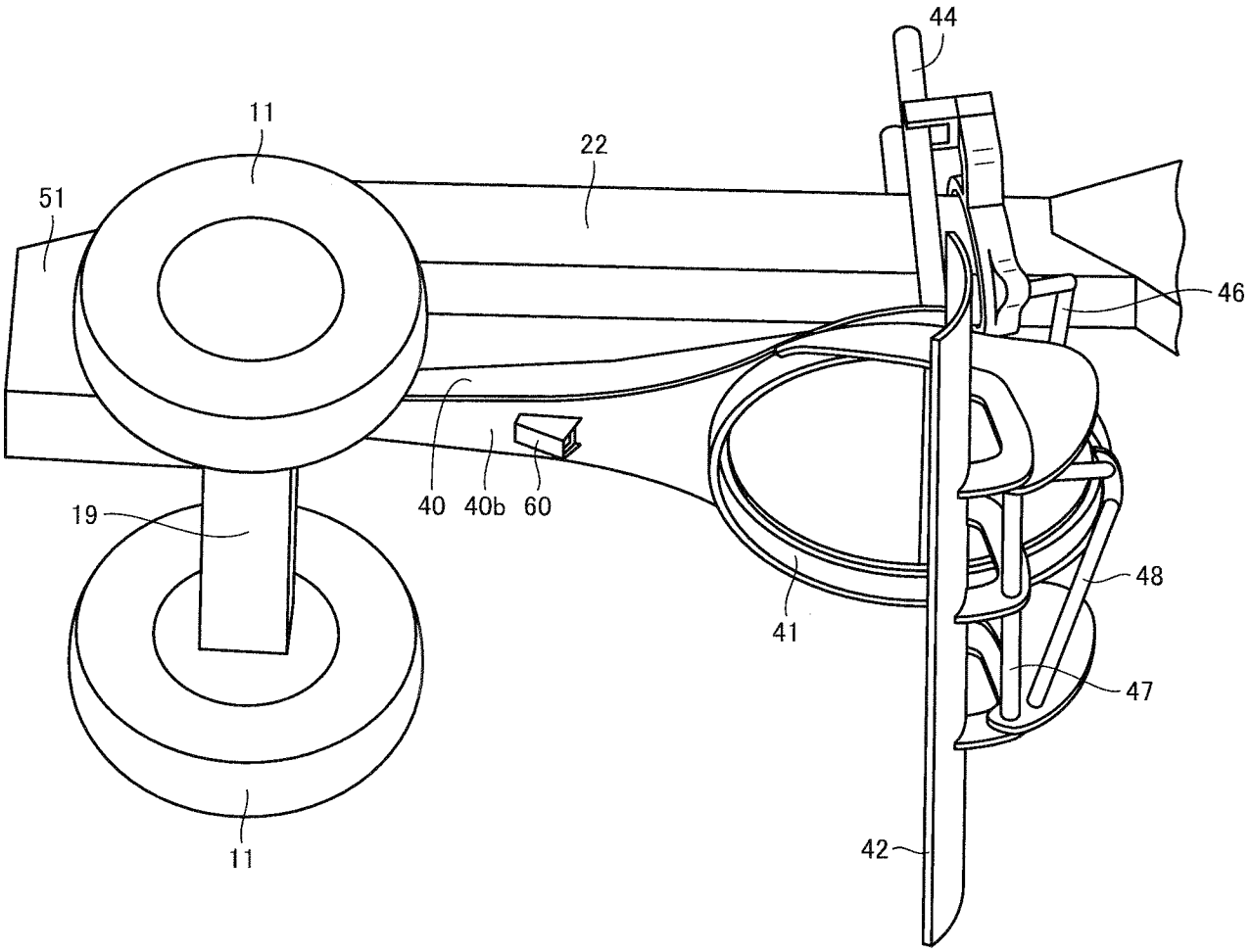
FIG. 7 is a perspective view showing a main part of the work implement of the motor grader based on a second embodiment.

FIG. 7 is a perspective view showing a main part of work implement 4 of motor grader 1 based on a second embodiment. Motor grader 1 in the second embodiment is different from the first embodiment in arrangement of image pick-up apparatus 60. Specifically, as shown in FIG. 7, no image pick-up apparatus is fixed to swing circle 41. Image pick-up apparatus 60 is fixed to a lower surface 40*b* of draw bar 40. Image pick-up apparatus 60 protrudes downward from lower surface 40*b* of draw bar 40.

Image pick-up apparatus 60 is arranged below front frame 22. Image pick-up apparatus 60 is arranged below draw bar 40. Image pick-up apparatus 60 is arranged in front of the foremost portion of swing circle 41.

Figure 8:
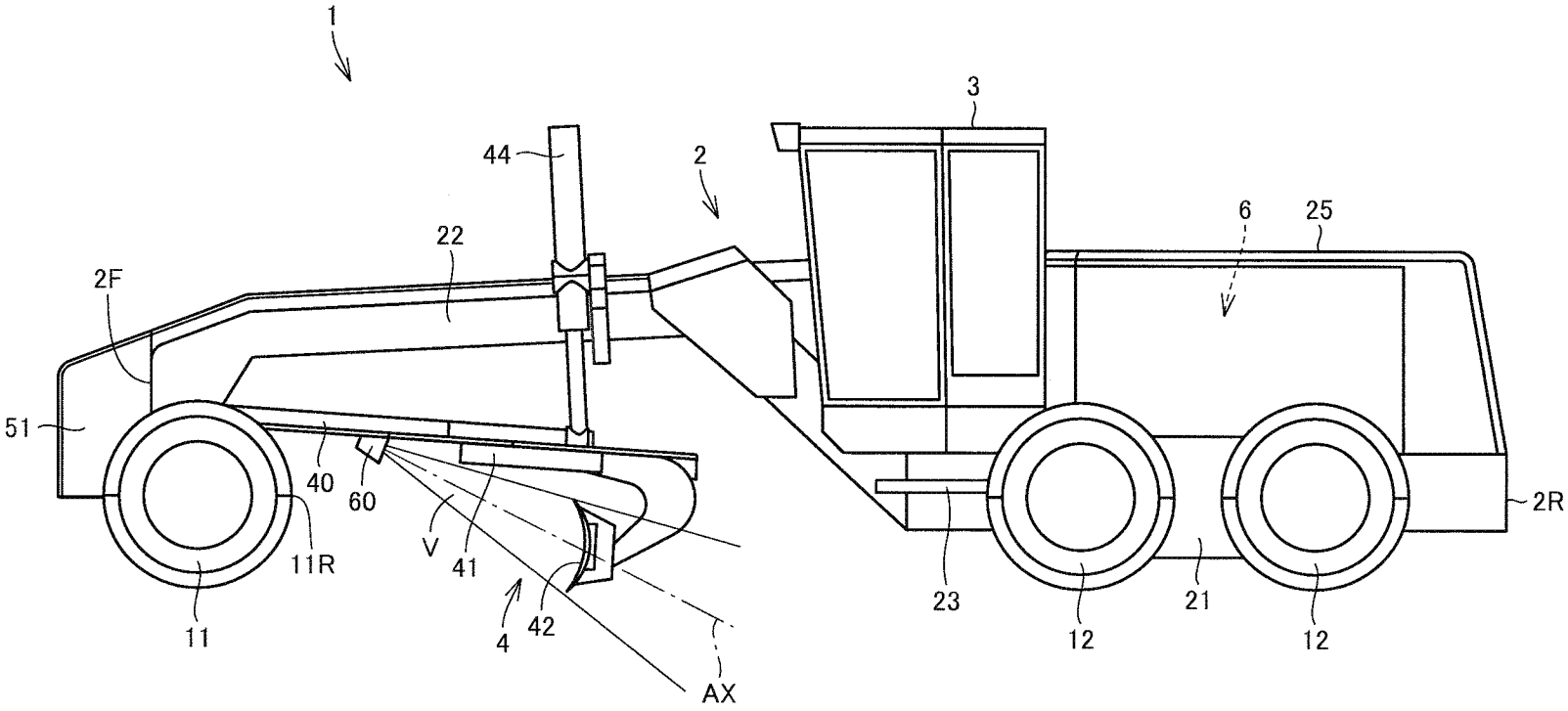
FIG. 8 is a schematic diagram showing a range of image pick-up by an image pick-up apparatus shown in FIG. 7.

FIG. 8 is a schematic diagram showing a range of image pick-up by image pick-up apparatus 60 shown in FIG. 7. As shown in FIG. 8, optical axis AX of image pick-up apparatus 60 extends rearward from image pick-up apparatus 60. Optical axis AX extends through the position of blade 42. Optical axis AX intersects with blade 42. Image pick-up apparatus 60 picks up an image of the front surface of blade 42. A range of image pick-up by image pick-up apparatus 60 includes blade 42. A part of blade 42 is included in angle of view V of image pick-up apparatus 60. The lower end of blade 42 is included in angle of view V of image pick-up apparatus 60. Image pick-up apparatus 60 can pick up an image of soil built up on the front surface of blade 42 while motor grader 1 travels forward.

With image pick-up apparatus 60 thus constructed, an amount of soil built up on the front surface of blade 42 can readily be known as in the first embodiment.

Third Embodiment

Figure 9:
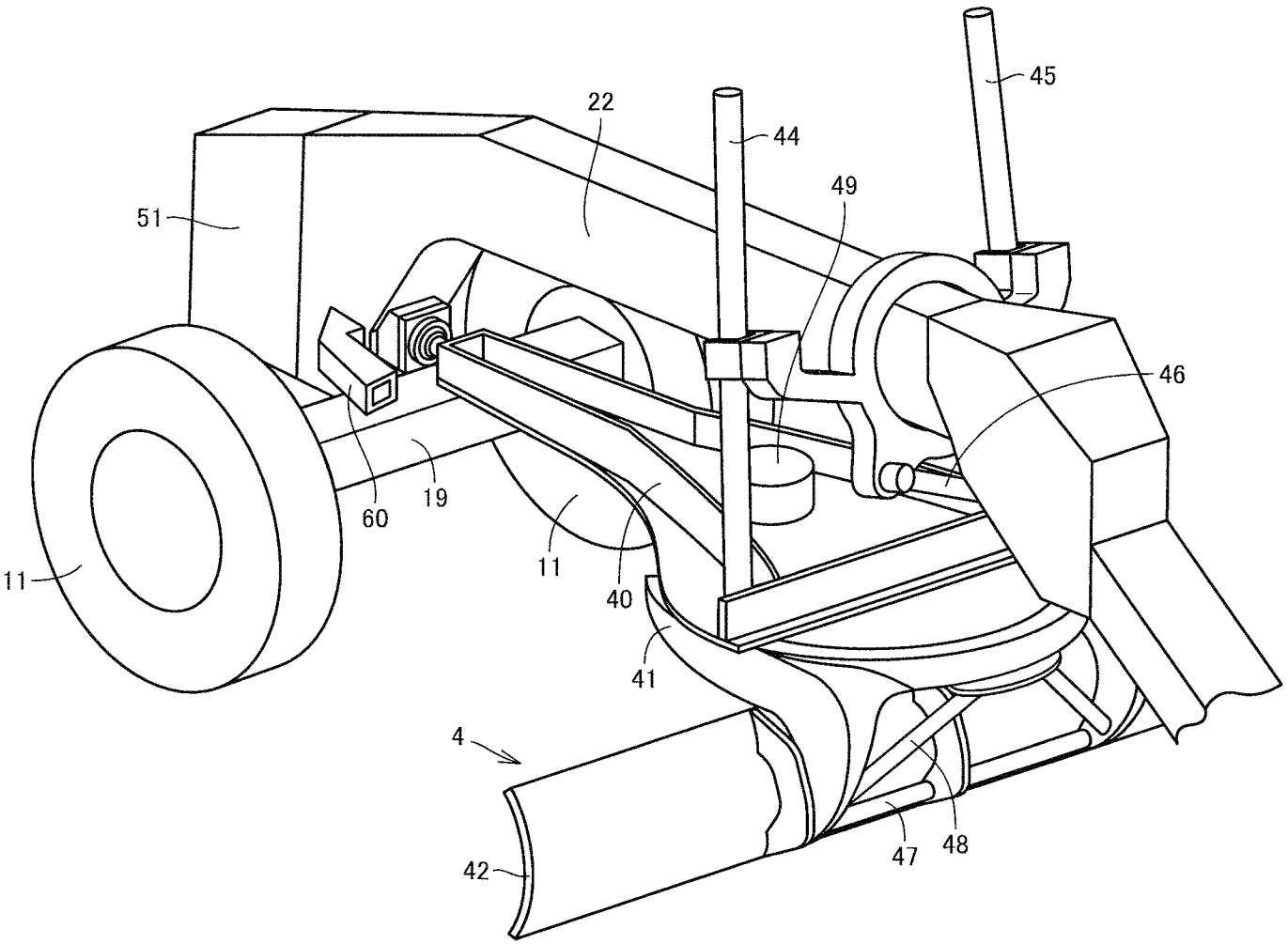
FIG. 9 is a perspective view showing a main part of the work implement of the motor grader based on a third embodiment.

FIG. 9 is a perspective view showing a main part of work implement 4 of motor grader 1 based on a third embodiment. Motor grader 1 in the third embodiment is different from the first and second embodiments in arrangement of image pick-up apparatus 60. Specifically, as shown in FIG. 9, no image pick-up apparatus is fixed to swing circle 41 and draw bar 40. Image pick-up apparatus 60 is fixed to a side surface of front frame 22. Image pick-up apparatus 60 protrudes laterally from the side surface at a lower end of the tip end portion of front frame 22.

Image pick-up apparatus 60 is arranged at a position displaced from the center in the lateral direction of motor grader 1. Image pick-up apparatus 60 includes an image pick-up portion provided as being inclined with respect to a vertical plane extending in the lateral direction. With inclination of the image pick-up portion, image pick-up apparatus 60 can pick up an image of a central portion in the lateral direction of blade 42.

As in the first and second embodiments, blade 42 is included in a range of image pick-up by image pick-up apparatus 60. Image pick-up apparatus 60 can pick up an image of soil built up on the front surface of blade 42 while motor grader 1 travels forward. With image pick-up apparatus 60 constructed as such, an amount of soil built up on the front surface of blade 42 can readily be known.

A function and effect of the embodiments described above will now be described.

Motor grader 1 representing one example of the work vehicle in the embodiments includes vehicular body frame 2, blade 42, and image pick-up apparatus 60 as shown in FIG. 2. Vehicular body frame 2 includes front frame 22 and rear frame 21. Blade 42 is arranged between front end 2F of vehicular body frame 2 and rear end 2R of vehicular body frame 2. Blade 42 is supported on front frame 22. As shown in FIG. 5, blade angle θ of blade 42 is adjustable. As shown in FIGS. 6 and 8, image pick-up apparatus 60 is arranged in front of blade 42. Image pick-up apparatus 60 includes at least a part of blade 42 within angle of view V.

Motor grader 1 in the embodiments can pick up an image of the front surface of blade 42 with image pick-up apparatus 60. Image pick-up apparatus 60 can pick up an image of soil built up on the front surface of blade 42. As a result of image pick-up by image pick-up apparatus 60, an amount of soil built up on the front surface of blade 42 can readily be known.

As shown in FIG. 2, motor grader 1 further includes front wheel 11 arranged in front of blade 42 and rear wheel 12 arranged in the rear of blade 42. By doing so, image pick-up apparatus 60 can pick up an image of soil built up on the front surface of blade 42 arranged between front wheel 11 and rear wheel 12, and as a result of image pick-up by image pick-up apparatus 60, an amount of soil built up on the front surface of blade 42 can readily be known.

As shown in FIG. 2, image pick-up apparatus 60 is arranged between blade 42 and front wheel 11. By doing so, image pick-up apparatus 60 arranged between blade 42 and front wheel 11 can pick up an image of soil built up on the front surface of blade 42, and as a result of image pick-up by image pick-up apparatus 60, an amount of soil built up on the front surface of blade 42 can readily be known.

As shown in FIGS. 10 to 12, image pick-up apparatus 60 includes lower end 42*b* of blade 42 within its angle of view V. Image pick-up apparatus 60 thus constructed can reliably pick up an image of the front surface of blade 42. Image pick-up apparatus 60 can pick up an image of soil built up on the front surface of blade 42, and as a result of image pick-up by image pick-up apparatus 60, an amount of soil built up on the front surface of blade 42 can readily be known.

As shown in FIGS. 10 and 11, image pick-up apparatus 60 has optical axis AX intersecting with blade 42. Image pick-up apparatus 60 thus constructed can reliably pick up an image of the front surface of blade 42. Image pick-up apparatus 60 can pick up an image of soil built up on the front surface of blade 42, and as a result of image pick-up by image pick-up apparatus 60, an amount of soil built up on the front surface of blade 42 can readily be known.

As shown in FIG. 2, motor grader 1 further includes articulation cylinder 23 attached between front frame 22 and rear frame 21. By extending and retracting articulation cylinder 23, front frame 22 can pivot with respect to rear frame 21 and front frame 22 can bend with respect to rear frame 21. A slewing radius at the time of revolution of motor grader 1 can thus be smaller. In addition, works for excavating a groove and works for cutting a slope by offset running of motor grader 1 can be done. Offset running refers to linear travel of motor grader 1 by setting a direction of bending of front frame 22 with respect to rear frame 21 and a direction of revolution of front wheel 11 with respect to front frame 22 to directions opposite to each other.

As shown in FIG. 2, image pick-up apparatus 60 is arranged below front frame 22. Both of image pick-up apparatus 60 which picks up an image of blade 42 and blade 42 of which image is to be picked up are arranged below front frame 22. Thus, front frame 22 is not present within angle of view V of image pick-up apparatus 60 which picks up an image of blade 42, and front frame 22 obstructing image pick-up of blade 42 by image pick-up apparatus 60 is avoided. Therefore, image pick-up apparatus 60 can reliably pick up an image of the front surface of blade 42.

As shown in FIGS. 2 to 4, motor grader 1 further includes swing circle 41. Swing circle 41 is arranged below the front frame. Blade 42 is disposed on swing circle 41. Image pick-up apparatus 60 is fixed to lower surface 41*b* of swing circle 41. By doing so, a component of motor grader 1 is less likely to be present within angle of view V of image pick-up apparatus 60, and the component of motor grader 1 obstructing image pick-up of blade 42 by image pick-up apparatus 60 is suppressed. Image pick-up apparatus 60 can thus reliably pick up an image of the front surface of blade 42.

Blade 42 pivots with revolution of swing circle 41 so that blade angle θ varies. According to such a construction that image pick-up apparatus 60 is fixed to swing circle 41 which rotates, image pick-up apparatus 60 and blade 42 revolve together with revolution of swing circle 41. Since positions of image pick-up apparatus 60 and blade 42 relative to each other do not vary in spite of variation in blade angle θ, image pick-up apparatus 60 can reliably pick up an image of the front surface of blade 42.

As shown in FIGS. 7 and 8, motor grader 1 further includes draw bar 40. Draw bar 40 has one end coupled to front frame 22. Draw bar 40 supports blade 42. Image pick-up apparatus 60 is fixed to lower surface 40*b* of draw bar 40. By doing so, a component of motor grader 1 is less likely to be present within angle of view V of image pick-up apparatus 60, and the component of motor grader 1 obstructing image pick-up of blade 42 by image pick-up apparatus 60 is suppressed. Image pick-up apparatus 60 can thus reliably pick up an image of the front surface of blade 42.

Though motor grader 1 includes cab 3 in the embodiments described so far, motor grader 1 does not necessarily have to include cab 3. Motor grader 1 is not limited to such specifications that an operator is on board motor grader 1 to operate motor grader 1, but the specifications may be such that the motor grader is operated under external remote control. Since motor grader 1 does not require cab 3 for an operator to get on board in this case, motor grader 1 does not have to include cab 3.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1 motor grader; 2 vehicular body frame; 2F front end; 2R rear end; 3 cab; 4 work implement; 11 front wheel; 11R rearmost portion; 12 rear wheel; 21 rear frame; 22 front frame; 40 draw bar; 40*b*, 41*b* lower surface; 41 swing circle; 42 blade; 42*b* lower end; 44, 45 lift cylinder; 46 draw bar shift cylinder; 47 blade shift cylinder; 48 tilt cylinder; 49 hydraulic motor; 51 counter weight; 60 image pick-up apparatus; 402 ball bearing portion; 910 rotation axis; 920 central axis; AX optical axis; and V angle of view

The invention claimed is:

1. A motor grader comprising:

a vehicular body frame that includes a front frame and a rear frame;

a draw bar having one end coupled to the front frame;

a blade arranged between a front end of the vehicular body frame and a rear end of the vehicular body frame and supported on the front frame of the vehicular body frame; and an image pick-up apparatus arranged in front of the blade, at least a part of a front surface of the blade being included within an angle of view of the image pick-up apparatus, the image pick-up apparatus picking-up at least one image of an amount of soil built up on a front surface of the blade, wherein the image pick-up apparatus is arranged below the draw bar, and wherein a revolving operation of the blade is automatically controlled based on the amount of soil built up on the front surface of the blade.

2. The motor grader according to claim 1, the motor grader further comprising:

a front wheel arranged in front of the blade; and a rear wheel arranged in rear of the blade.

3. The motor grader according to claim 2, wherein the image pick-up apparatus is arranged between the blade and the front wheel.

4. The motor grader according to claim 1, wherein at least a lower end of the blade is included in the angle of view of the image pick-up apparatus.

5. The motor grader according to claim 1, wherein the image pick-up apparatus includes an optical axis which intersects with the blade.

6. The motor grader according to claim 1, the motor grader further comprising an articulation cylinder attached between the front frame and the rear frame.

7. The motor grader according to claim 1, the motor grader further comprising a swing circle arranged below the front frame, the blade is disposed on the swing circle, wherein the image pick-up apparatus is fixed to a lower surface of the swing circle.

8. The motor grader according to claim 1, wherein the draw bar supporting the blade, and wherein the image pick-up apparatus is fixed to a lower surface of the draw bar.

9. The motor grader according to claim 7, wherein the image pick-up apparatus is fixed to a position on the swing circle most distant from the blade.

* * * * *